US007681650B2

(12) United States Patent
Telfer et al.

(10) Patent No.: US 7,681,650 B2
(45) Date of Patent: Mar. 23, 2010

(54) VALVE SEAT

(75) Inventors: George Telfer, Aberdeen (GB); Edward Docherty Scott, Fife (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 369 days.

(21) Appl. No.: 11/579,210

(22) PCT Filed: Apr. 29, 2005

(86) PCT No.: PCT/GB2005/001662

§ 371 (c)(1),
(2), (4) Date: Jul. 24, 2007

(87) PCT Pub. No.: WO2005/106186

PCT Pub. Date: Nov. 10, 2005

(65) Prior Publication Data

US 2007/0295507 A1 Dec. 27, 2007

(30) Foreign Application Priority Data

Apr. 30, 2004 (GB) ..... 0409619.4

(51) Int. Cl.
*E21B 34/06* (2006.01)

(52) U.S. Cl. ..... 166/386; 166/193; 166/326; 251/359

(58) Field of Classification Search ..... 166/386, 166/193, 326, 318; 137/843, 844; 251/359, 251/365, 368
See application file for complete search history.

(56) References Cited

U.S. PATENT DOCUMENTS 3,007,527 A * 11/1961 Nelson ..... 166/326
3,289,769 A * 12/1966 Nelson et al. ..... 166/326
3,655,822 A * 4/1972 Matzner et al. ..... 525/432
4,907,649 A * 3/1990 Bode ..... 166/70
5,020,612 A * 6/1991 Williams ..... 175/234
5,038,862 A * 8/1991 Giroux et al. ..... 166/289
5,105,883 A * 4/1992 Bode ..... 166/255.1
5,146,992 A 9/1992 Baugh et al.
5,297,580 A * 3/1994 Thurman ..... 137/533.15
5,909,771 A * 6/1999 Giroux et al. ..... 166/120
6,293,517 B1 9/2001 Cunningham (Continued)

FOREIGN PATENT DOCUMENTS

EA 0 484 672 5/1992

OTHER PUBLICATIONS

International Search Report for PCT/GB2005/001662 mailed Aug. 5, 2005 (2 pages).

*Primary Examiner*—Shane Bomar
(74) *Attorney, Agent, or Firm*—Osha • Liang LLP

(57) ABSTRACT

A ball valve seat (10) is disclosed which provides a temporary seal for a plug (40). The valve seat comprises a substantially cylindrical body (30) of a first volume, which defines a seating surface (34). A pressure differential is developed across the valve seat when the plug sealingly engages the seating surface. The body is formed of an elastic material which compresses from a first volume to a smaller second volume by application of a force on the plug, to provide a clearance which is greater than a plugging dimension of the plug, thus allowing passage of the plug downstream. After passage of the plug, the body returns to the first volume.

21 Claims, 1 Drawing Sheet

Figure 1:
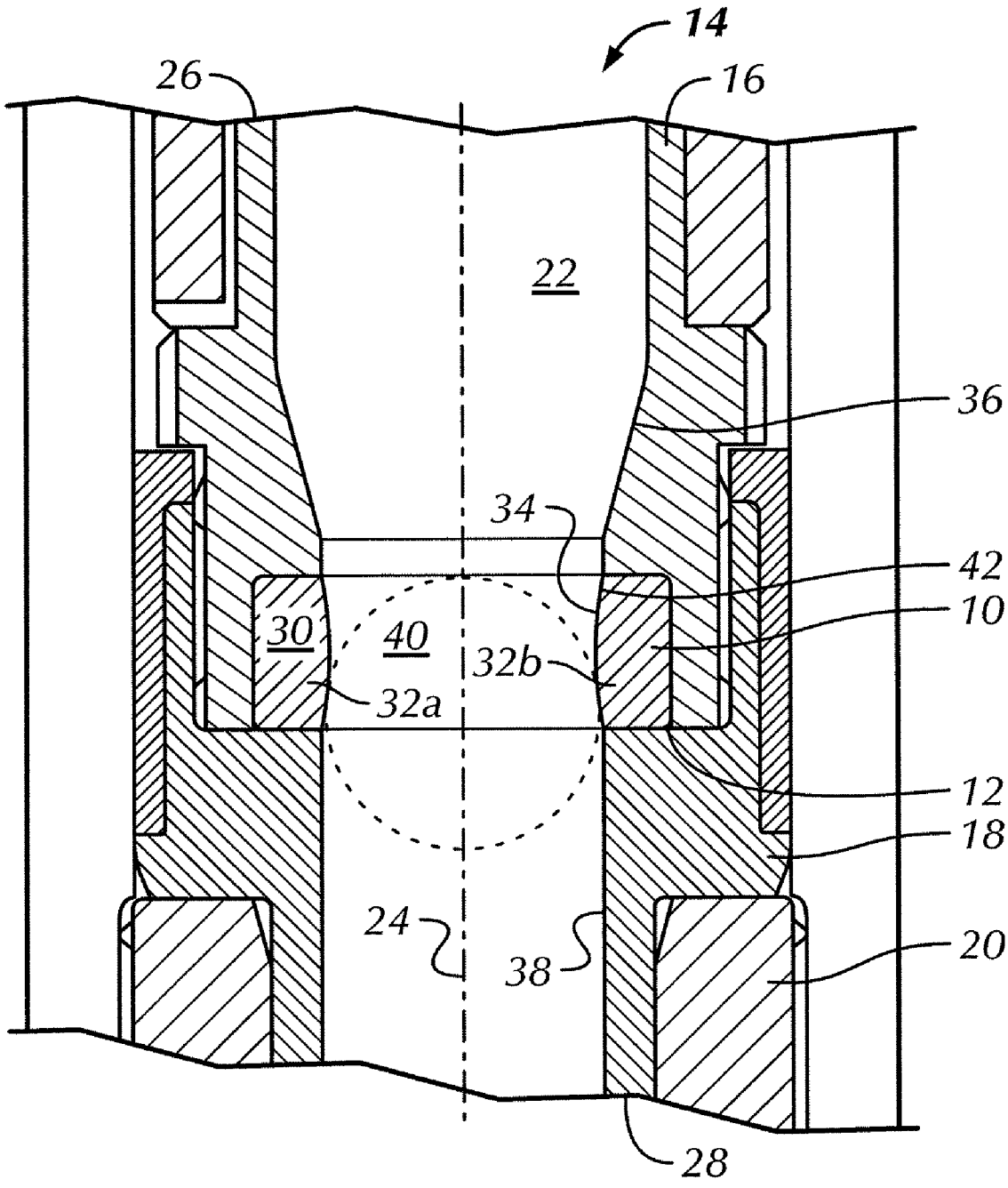

U.S. PATENT DOCUMENTS 6,695,285 B1 * 2/2004 Hotton et al. ..... 251/315.01
6,725,935 B2 * 4/2004 Szarka et al. ..... 166/318
6,776,617 B2 * 8/2004 Lax ..... 433/221
7,461,829 B2 * 12/2008 Rule ..... 251/318
7,503,392 B2 * 3/2009 King et al. ..... 166/373
2004/0007359 A1 * 1/2004 Stevens et al. ..... 166/285

* cited by examiner

VALVE SEAT

The present invention relates to valves used in downhole tools within the oil and gas industry and, in particular, a ball valve seat which provides a temporary seal for a travelling plug through the valve seat.

In the drilling, completion and production of oil and gas wells, downhole tools are mounted on a work string and run into a well bore to perform tasks or operations at locations within the well bore. A known method of getting the tool to perform the task at the required time and location, is to drop a plug, typically in the form of a ball, through the work string, to engage with and actuate the tool. Such plugs are carried with the fluid flow to the tool whereupon they encounter a valve seat and provide a sealed obstruction to the fluid flow path.

Commonly, shearable connectors, such as shear pins, are used in combination with the plug and valve seat to render the obstruction of a fluid flow path reversible. In practice, the plug sealingly engages the valve seat over a range of operating pressures. When a predetermined fluid pressure threshold is exceeded, the pins shear, opening fluid paths around the combination of the plug and valve seat. A disadvantage of this approach is that the tool must be designed with bypass channels which open around the plug and valve seat when the pins shear. These designs are expensive to manufacture and the channels can become blocked with debris carried in the well bore fluid.

A further disadvantage of these designs is that once the plug is seated, the central bore of the work string is permanently obstructed. This prevents the passage of other strings such as wireline through the work string.

To overcome this problem various valves have been designed with the aim of temporarily holding the plug while the tool is actuated and then releasing the plug to travel further through the work string. Deformable balls have been used which deform over a pressure threshold to squeeze through the valve seat. A disadvantage of these deformable balls is that they are typically made of materials which can be susceptible to damage as the ball passes down the work string. If damaged they may not form a seal at the valve seat.

Releasable valve seats have been proposed which rely on a collet to hold the ball temporarily. These seats can lack the effective seal between the ball and seat.

Metal valve seats have also been proposed, for example in U.S. Pat. No. 5,146,992. This presents an aluminium valve seat which is adapted for receiving and temporarily sealingly engaging, a valve plug which is positionable within the wellbore. The seat includes a sealing lip which is adapted for sealingly engaging the valve plug and for substantially occluding the passage of fluid from an upstream location to a downstream location, wherein a pressure differential developed across the valve seat and plug operates to deform the sealing lip and allow passage of the valve plug downstream within the fluid conduit, when a predetermined amount of force is applied thereto.

While this arrangement has the advantage of temporarily sealing at the valve and allowing the plug to be later released, the valve seat has a number of disadvantages. The main disadvantage is that once a plug has passed through the seat, the valve seat has been deformed, providing a wider clearance, so that a plug of similar or identical dimensions would not seat within the valve, but pass therethrough. This means that the valve seat can only be used once with a valve plug of a first dimension, and if a further occlusion of the fluid passage is required, each consecutive plug must have a greater plugging dimension. This requires the operator to be fully aware of the properties of the material used and how it will behave under pressure and temperature to provide a plug which will have sufficient dimensions to make an effective seal on the seat, whilst still being able to deform the valve seat at a required pressure differential.

A further disadvantage of this invention is that the deformation takes place primarily at a sealing lip, the sealing lip extending in the direction of fluid flow. There is therefore a cavity behind the sealing lip into which the sealing lip moves or deforms. Debris and other deleterious material within the flow path can collect or gather behind the sealing lip. This will then restrict the amount of deformation that can take place, and thus a plug can become stuck within the valve seat, and the assembly will have to be removed from the well bore at substantial cost.

It is therefore an object of the present invention to provide a valve seat for use with a plug in a downhole tool which can be repeatably used for the temporary occlusion of fluid flow through the tool by the use of plugs having similar or identical plugging dimensions.

It is a further object of at least one embodiment of the present invention to provide a valve seat which is truly elastic, in that it deforms within its own volume when pressure is applied, and returns to its original shape on release of the pressure.

According to a first aspect of the present invention, there is provided a valve seat, adapted for receiving a plug having a plugging dimension, for use in a fluid conduit of a downhole tool having an inner wall disposed about a central longitudinal axis, said inner wall defining a central bore for passage of fluid from an upstream location to a downstream location, comprising:

a substantially cylindrical body having a first bore therethrough defined by an inner surface of the body and the body being of a first volume;

a first clearance through said body, defined by a portion of said inner surface, which is smaller than the plugging dimension;

a seating surface located upon the inner surface facing upstream for sealingly engaging with said plug and substantially occluding passage of said fluid from said upstream location to said downstream location;

wherein a pressure differential is developed across said valve seat when said plug sealingly engages said seating surface, applying force to said seating surface;

said body being formed of an elastic material which compresses to a second volume, smaller than said first volume, by application of said force to provide a second clearance to said body which is greater than the plugging dimension, and thus allows passage to said plug downstream within said fluid conduit; and wherein after passage of said plug, said body returns to said first volume with substantially said first clearance.

As the valve seat is elastic, it compresses under the force of the plug so that the outer dimensions of the body remain the same while the bore increases radially to provide sufficient clearance for the plug to pass through the seat. Further, as the valve seat returns to its same shape and volume after passage of the plug, an identical plug can be dropped and the process repeated an indeterminate number of times.

Preferably the elastic material is a polymer.

More preferably the elastic material is a thermoplastic polymer. Such thermoplastics include polyethylene and polypropylene.

The elastic material may be a thermoplastic polycondensate such as a polyamide or nylon.

The elastic material is preferably the thermoplastic polycondensate, polyetheretherketone (PEEK). Indeed, those skilled in the art will appreciate that materials which exhibit visco-elastic properties similar to polyetheretherketone would be acceptable. Polyetheretherketone is also known under the trade names Arotone, Doctalex, Kadel, Mindel, PEEK, Santolite, Staver, Ultrapek and Zyex.

Preferably also the elastic material is a virgin material. Alternatively the elastic material may include an additive. The additive may be glass granules. Alternatively the additive may a fibre filler, such as carbon. The additive may be in a quantity of approximately 10 to 30%.

Preferably said inner surface is arcuate with said central longitudinal axis. More preferably, said inner surface is convex to said central longitudinal axis. Preferably an apex of the convex defines the first clearance. Such an arcuate profile provides a venturi feature as the gentle angle, both in and out through the valve seat will cause the plug to be sucked into the seat via the Bernoulli effect. Thus, the inner surface provides a gradual decrease to the first clearance which is symmetrical to the central longitudinal axis.

Preferably the inner surface is continuous with the inner wall. This provides a non-turbulent fluid flow stream through the fluid conduit.

According to a second aspect of the present invention, there is provided a method of sealing a central bore of a downhole tool to temporarily prevent passage of fluid from an upstream location to a downstream location comprising:

(a) providing an elastic valve seat having a first volume and defining a seat clearance within said central bore;
(b) providing a first plug having a first plugging dimension, which exceeds said seat clearance of said elastic valve seat;
(c) seating said first plug against said elastic valve seat;
(d) developing, with said fluid, a differential pressure across said elastic valve seat; and
(e) compressing said elastic valve seat at a pre-selected pressure differential level to a second volume, smaller than said first volume, to provide a clearance greater than the seat clearance and allow passage of said first plug through said elastic valve seat, wherein said elastic valve seat returns to its first volume upon clearance of the first plug.

Preferably the method of sealing further comprises the steps of:

(f) providing at least one additional plug, which together with said first plug constitutes a plurality of plugs having substantially similar plugging dimensions;
(g) successively seating said plurality of plugs against said elastic valve seat;
(h) successively developing, with said fluid, the same pressure differential across said elastic valve seat; and
(i) successively compressing said elastic valve seat at the pre-selected pressure differential level to provide clearance for said plurality of valve plugs to pass through said elastic seat and return the valve seat to its first volume between successive seatings.

Advantageously, the method includes the step of sucking said plug towards said valve seat, as said plug approaches said valve seat.

An embodiment of the present invention will now be described, by way of example only, with reference to the accompanying FIGURE.

FIG. 1 is a longitudinal section view through a portion of a downhole tool, as would be used in the oil and gas industry. The valve seat 10 is located within a recess 12 made from parts, generally indicated 14, of the downhole tool. Parts 14 comprise an upper section 16, mid section 18 and a lower section 20. Sections 16, 18, 20 are provided for assembly purposes of the tool, and will all move together as the seat 10 moves through the central bore 22.

The central bore 22 is located on a longitudinal axis 24 running symmetrically through the tool parts 14. The central bore 22 provides a fluid conduit from upstream to downstream, upstream being located towards the upper end 26 of the tool parts 14, and downstream being located towards and extending from the lower end 28 of the tool parts 14.

Recess 12 provides a substantially annular recess having a rectangular cross-section in the central bore 22. The recess 12 is made from the upper part 16 and mid part 18 of the tool parts 14. Located as a tight fit within the recess 12 is the valve seat 10.

The valve seat 10 comprises a unitary annular body 30 being donut or ring shaped. In cross-section, as shown in the FIGURE, it provides two opposite identical faces being mirror images. Each face 32 *a,b* comprises substantially planar upper and lower surfaces. A substantially cylindrical outer surface abuts the recess base. An inner surface 34 faces the central bore 22. Inner surface 34 is substantially cylindrical with an arcuate profile on the longitudinal axis 24. The profile is made from a radius or arc with an apex or rise at a midpoint over the surface 34. As illustrated, the body 30 defines a first volume.

The seat 10 is formed of polyetheretherketone, commonly referred to as PEEK. PEEK is a semi-crystalline polymer and falls within the class of thermoplastic polycondensates. This material goes under the trade names of PEEK, Arotone, Doctalex, Kadel, Mindel, Santolite, Staver, Ultrapek and Zyex. PEEK has a high tensile and flexural strength, high impact strength and a high fatigue limit. Additionally it has a high heat distortion temperature, high chemical resistance and high radiation resistance. It further has good electrical properties, good slip and wear characteristics and low flammability. The material can be injection moulded and may be formed with approximately a 10 to 30% addition of glass granules. The addition of glass to PEEK increases its flexural modulus.

It is the visco-elastic properties of this material that make it suitable, in that it can be compressed repeatedly and will always return to its original volume and dimensions.

The typical mechanical properties of PEEK are:

| | |
|---|---|
| Tensile stress at yield, at break | 92 N/mm$^2$ |
| Tensile modulus of elasticity | 3,600 N/mm$^2$ |
| Flexural modulus | 5 to 25 Gpa over −100 to 150° C. |

Those skilled in the art will appreciate that other materials may be used for the formation of the valve seat, providing they have visco-elastic properties which are around those found in PEEK. It is likely that these will come from polymers, e.g., polyamide (nylon), polyethylene, polypropylene and elastomers.

In use, the single piece valve seat 10 is located in a downhole tool between mating parts 16, 18. Preferably the seat 10 is located within a recess 12, such that the inner surface 34 aligns with the inner surfaces 36,38 of the central bore 22 both above and below the seat 10. The surfaces 36,38, together with the inner surface 34, are provided with gentle angles and slopes, such that they provide a non-turbulent flow of fluid through the central bore 22.

As it is located in the tool, the valve seat 10 is positioned within a wellbore in a work string in which the tool is situated. The material of the seat 10 is non-erodable, thus chemicals and other flushing materials, such as muds, can be pumped through the bore 22 without damage to the seat 10. Further, as the seat is formed of a relative soft material, it will not catch on any wireline or other tool inserted through the bore 22.

When a plug in the form of a ball 40 is released through the work string, it will travel in the fluid through the central bore 22. The ball 40 is sized to have a dimension or diameter greater than the clearance through the seat 10 at the inner wall 34. In this way, as the ball 40 travels through the bore 22 it will come to rest upon the seat 10. This mating occurs at the upper edge of the seat 10 against a surface 42. The surface 42 may be referred to as a seating or sealing surface, as a seal is formed due to the circumferential match of the ball and the valve seat 10, as they come together. The ball 40 is then seated in the valve seat 10.

Due the arcuate profile of the surface 42 on the inner surface 34, the ball 40 will be sucked towards the seat 10, as it moves towards the seat due to the Bernoulli effect. This prevents the ball from chattering or otherwise travelling back up the bore 22. Such phenomena exists if the ball 40 may be made of a light weight material and the fluid pressure through the bore 22 is insufficient to carry the ball with sufficient force to the seat. Additionally, the action of sucking the ball 40 towards the seat 10 assists in tools which are located in horizontal or deviated wells where gravity is not available to assist passage of the ball 40.

With the ball 40 on the sealing surface 42 of the seat 10, fluid flow from upstream to downstream through the bore 22 is prevented. As fluid is pumped towards the ball 40 from upstream, a pressure differential will occur across the valve seat 10. The force upon the ball 40 will be translated to a force on to the sealing surface 42 and to the body 30. This force will begin to compress the material of the seat 10. Compression will move the inner surface 34 radially into its own body 30. The body 30 does not yield, expand, extrude or deform. This is not required as the material of the seat itself will compress into a smaller volume as the ball 40 pushes its way through the seat 10. This is evidenced by the fact that the recess 12 is of substantially the same dimensions as the body 30, so that there is no room for the body to yield, extrude or deform by expanding out of the central bore 22. As the seat 10 is compressed, the clearance through the seat 10 will increase until it has the same dimensions of the ball 40, whereupon the ball 40 will pass through the seat. Pressure upon the ball will now force the ball 40 through the remainder of the bore 22 and a drop in the pressure differential will be noted at the well surface as fluid flow is restored through the bore 22.

For the period of time that the ball is located on the sealing surface 42 and fluid is occluded through the bore 22, the additional pressure differential not only forces the ball 40 through the seat 10, it will also have the effect of forcing everything in line with this surface 42 downstream. In the embodiment shown, it will mean that the parts 16, 18 and 20 will be forced relatively downstream with respect to the work string to which the tool is attached. This movement of the parts causes actuation of the tool. On release of the ball through the valve seat 10, if springs are located in the tool, these may reposition the parts 16, 18, 20 on release of the ball. Thus the tool is both actuated and returned to its initial configuration by the passage of a single ball through the valve seat.

As an example embodiment, a valve seat being provided with an outer diameter of 82.55 mm, a depth of 30.75 mm, an arcuate profile radius of 76.55 mm and a clearance at the input and output faces of 55.55 mm will operate with a steel drop ball having a diameter of 52.43 mm.

The principle advantage of the present invention is that it provides a ball valve seat which can be used a multiple number of times to temporarily halt the passage of a ball through the valve seat, the valve seat being self-healing and returning to its original dimensions after the passage of each ball. This allows the repetitive deployment of identical drop balls through a downhole tool to actuate the tool any chosen number of times.

A further advantage of the present invention is that the valve seat is shaped to provide a venturi effect as a plug or drop ball reaches the valve seat. This effectively sucks the ball into the seat, providing a firm seating to the ball.

Various modifications may be made to the invention herein described without departing from the scope thereof. For example, as discussed, any suitable material having visco-elastic properties which exhibit the compressible feature required of the invention could be used. Further, the relative dimensions of the valve seat may be altered to suit the size of drop ball required, and the degree of space available to provide a recess. Further, the radius of the arcuate surface of the seat within the bore can be selected to provide a required pressure differential level at which the tool will activate.

The invention claimed is:

1. A downhole tool for attachment to a work string, the downhole tool having an inner wall disposed above a central longitudinal axis, the inner wall defining a central bore for passage of fluid from an upstream location to a downstream location; the downhole tool also having a valve seat, adapted for receiving a plug having a plugging dimension, for use in the central bore of the downhole tool, wherein the valve seat comprises:

a substantially cylindrical body having a first bore therethrough defined by an inner surface of the body and the body being of a first volume;

a first clearance through said body, defined by a portion of said inner surface, which is smaller than the plugging dimension;

a seating surface located upon the inner surface facing upstream for sealingly engaging with said plug and substantially occluding passage of said fluid from said upstream location to said downstream location;

wherein a pressure differential is developed across said valve seat when said plug sealingly engages said seating surface, applying force to said seating surface;

said body being formed of an elastic material which compresses to a second volume, smaller than said first volume, by application of said force to provide a second clearance to said body which is greater than the plugging dimension, and thus allows passage of said plug downstream within said fluid conduit; and wherein after passage of said plug, said body returns to said first volume with substantially said first clearance;

wherein the central bore of the downhole tool has an open upper end for receiving the plug, and wherein the tool is actuated and returned to its initial configuration by the passage of the plug through the valve seat.

2. A valve seat as claimed in claim 1, wherein the elastic material is a polymer.

3. A valve seat as claimed in claim 2, wherein the elastic material is a thermoplastic polymer.

4. A valve seat as claimed in claim 3, wherein the elastic material is selected from the group consisting of polyethylene and polypropylene.

5. A valve seat as claimed in claim 1, wherein the elastic material is a thermoplastic polycondensate.

6. A valve seat as claimed in claim 5, wherein the elastic material is selected from the group consisting of polyamide and nylon.

7. A valve seat as claimed in claim 5, wherein the thermoplastic polycondensate is polyetheretherketone (PEEK).

8. A valve seat as claimed in claim 1, wherein the elastic material is a virgin material.

9. A valve seat as claimed in claim 1, wherein the elastic material includes an additive.

10. A valve seat as claimed in claim 9, wherein the additive is glass granules.

11. A valve seat as claimed in claim 9, wherein the additive is a fibre filler.

12. A valve seat as claimed in claim 9, wherein the additive is in a quantity of approximately 10 to 30%.

13. A valve seat as claimed in claim 1, wherein said inner surface is arcuate with respect to said central longitudinal axis.

14. A valve seat as claimed in claim 13, wherein said inner surface is convex to said central longitudinal axis.

15. A valve seat as claimed in claim 14, wherein an apex of the convex defines the first clearance.

16. A valve seat as claimed in claim 13, wherein an arcuate profile provides a venturi feature adapted to cause the plug to be sucked into the seat via the Bernoulli effect.

17. A valve seat as claimed in claim 16, wherein the inner surface provides a gradual decrease to the first clearance which is symmetrical to the central longitudinal axis.

18. A valve seat as claimed in claim 1, wherein the inner surface is continuous with the inner wall.

19. A method of sealing a central bore of a downhole tool to temporarily prevent passage of fluid from an upstream location to a downstream location comprising:

providing an elastic valve seat within said central bore, the elastic valve seat having a first volume and defining a seat clearance and the central bore having an open upper end for receiving a first plug;

providing the first plug having a first plugging dimension, which exceeds said seat clearance of said elastic valve seat;

seating said first plug against said elastic valve seat;

developing, with said fluid, a differential pressure across said elastic valve seat; and compressing said elastic valve seat at a pre-selected pressure differential level to a second volume, smaller than said first volume, to provide a clearance greater than the seat clearance and allow passage of said first plug through said elastic valve seat, wherein said elastic valve seat returns to its first volume upon clearance of the first plug.

20. A method as claimed in claim 19, further comprising the steps of:

providing at least one additional plug, which together with said first plug constitutes a plurality of plugs having substantially similar plugging dimensions;

successively seating said plurality of plugs against said elastic valve seat;

successively developing, with said fluid, the same pressure differential across said elastic valve seat; and successively compressing said elastic valve seat at the pre-selected pressure differential level to provide clearance for said plurality of valve plugs to pass through said elastic seat and return the valve seat to its first volume between successive seatings.

21. A method as claimed in claim 19, including the step of sucking said plug towards said valve seat, as said plug approaches said valve seat.

* * * * *